United States Patent [19]

Havemann et al.

[11] Patent Number: 5,074,329

[45] Date of Patent: Dec. 24, 1991

[54] THREE-WAY VALVE FOR A REFRIGERATION SYSTEM

[75] Inventors: Robert K. Havemann, Bloomington; Darrel J. Hokanson, St. Louis Park, both of Minn.; William B. McKenzie, Stockbridge, Ga.

[73] Assignee: Thermo King Corporation, Minneapolis, Minn.

[21] Appl. No.: 611,559

[22] Filed: Nov. 13, 1990

[51] Int. Cl.[5] ..... F16K 11/044

[52] U.S. Cl. ..... 137/454.6; 62/324.6; 137/625.5

[58] Field of Search ..... 137/454.2, 454.6, 625.5; 62/324.6

[56] References Cited

U.S. PATENT DOCUMENTS

| | | | |
|---|---|---|---|
| 3,244,193 | 4/1966 | Loveless | 137/454.6 |
| 4,469,123 | 9/1984 | Merrill | 137/454.6 X |
| 4,485,846 | 12/1984 | Neff | 137/454.2 X |
| 4,587,991 | 5/1986 | Chorkey | 137/454.6 |
| 4,912,933 | 4/1990 | Renken . | |

OTHER PUBLICATIONS

"Thermo King 3-Way Valve", Drawing of Prior Art Valve, Thermo King Corporation, No Date.

*Primary Examiner*—Stephen M. Hepperle
*Attorney, Agent, or Firm*—D. R. Lackey

[57] ABSTRACT

A three-way valve for a refrigeration system having a body portion which includes an intermediate member and first and second end bells. The body portion includes an inlet adapted for connection to a refrigerant compressor, first and second major outlets respectively adapted for connection to a condenser and an evaporator, and a minor outlet adapted for selective connection to the low side of the compressor. The body portion defines a cavity within which a removable cartridge is disposed which contains all movable parts of the valve, as well as all parts subject to wear. The cartridge is freely removable for maintenance purposes after removal of a predetermined one of the end bells. An equalizing check valve is carried by the cartridge which limits back pressure build up via the first major outlet when the valve is positioned to connect the inlet to the second major outlet.

9 Claims, 4 Drawing Sheets

THREE-WAY VALVE FOR A REFRIGERATION SYSTEM

TECHNICAL FIELD

The invention relates in general to refrigeration valves, and more specifically to a three-way valve suitable for alternately directing refrigerant from the discharge side of a refrigerant compressor to a condenser or an evaporator.

BACKGROUND ART

It is common in transport refrigeration systems used to condition the cargo space of trucks and trailers to utilize a three-way valve to direct hot refrigerant gas from a refrigerant compressor to a condenser during a cooling mode, and to an evaporator during defrost and/or a heating mode. U.S. Pat. No. 4,912,933, which is assigned to the same assignee as the present application, describes such a transport refrigeration system in detail.

A prior art three-way valve of which we are aware is relatively costly to manufacture because of a pressure equalizing check valve which is assembled into the housing of the three-way valve. The portion of the three-way valve housing which receives a check valve requires costly angle drilling to form a cavity for the check valve. This prior art three-way valve art is also relatively costly to maintain, as a solder joint must be unsoldered and two gasketed joints must be opened in order to remove a stationary valve seat structure fixed to the inside of the housing. The stationary valve seat structure blocks the removal of a movable portion of this prior art three-way valve. The movable valve portion carries valve seals which contact the stationary valve seats. Re-soldering the joint in the field after maintenance of the three-way valve often results in refrigerant leaks.

SUMMARY OF THE INVENTION

Briefly, the present invention is three-way valve for a refrigeration system having a condenser, an evaporator, and a refrigerant compressor which includes discharge and suction sides. The three-way valve comprises a body portion including an intermediate body member having first and second axial ends, and first and second end bell members removably fixed to the first and second axial ends, respectively, via first and second gasket members. The intermediate body member and first and second end bell members cooperatively define an axially extending elongated cavity. The body portion of the three-way valve further includes an inlet adapted for connection to the discharge side of the refrigerant compressor, first and second major outlets adapted for connection to the condenser and evaporator, respectively, which are alternately selectable by the three-way valve, and a minor outlet adapted for selective connection to the suction side of the refrigerant compressor. According to the invention, a cylindrical cartridge is removably disposed within the elongated cavity of the body portion. The cartridge carries co-operable stationary and movable portions of the three-way valve, including first and second spaced stationary valve seats and first and second spaced valve seals which respectively contact the first and second valve seats to provide first and second operative positions. The first and second operative positions respectively connect the inlet of the valve body portion to the first and second major outlets. Since the movable portion of the valve is not required to co-operate with the valve body portion to effect the valve sealing functions, the cartridge is readily axially removable from the valve body portion for maintenance purposes. This is accomplished without interference between the cartridge and valve body portion, by removal of a predetermined one of the end bell members. Thus, no solder joints need be broken and re-soldered in order to maintain the three-way valve. The removable cartridge contains all of the stationary and movable parts of the valve which are subject to wear, and thus the three-way valve may be quickly serviced by replacing the existing cartridge with a new or rebuilt one.

A pressure limiting or equalizing check valve is co-axially carried by the cartridge, with the check valve being disposed to limit back pressure build up in the cartridge via the first major outlet when the inlet of the body portion is operatively connected to the second major outlet. This arrangement eliminates the need for angle drilling of the body portion of the three-way valve, ie., the valve housing. A shaft which carries an operating piston of the three-way valve also carries the check valve, with all drilling of the shaft required for the check valve function being co-axial with, and transverse to, the longitudinal axis of the shaft.

BRIEF DESCRIPTION OF THE DRAWINGS

The invention will become more apparent by reading the following detailed description in conjunction with the drawings, which are shown by way of example only, wherein.

DESCRIPTION OF PREFERRED EMBODIMENTS

Figure 1:
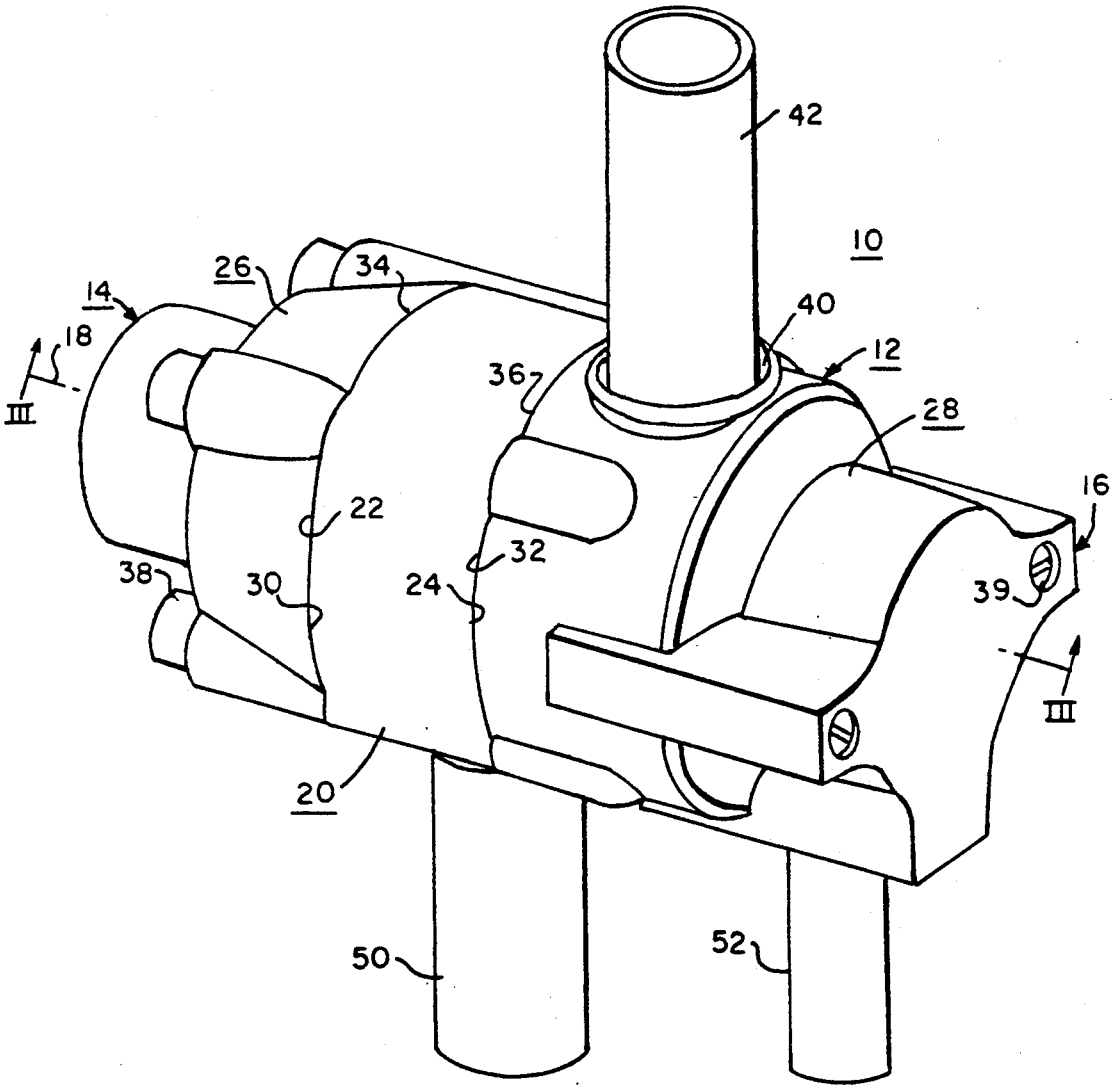
FIG. 1 is a perspective view of a three-way valve constructed according to the teachings of the invention.

Referring now to FIG. 1, there is shown a perspective view of a three-way valve 10 constructed according to the teachings of the invention. Three-way valve 10 includes a body portion or housing 12 having first and second axial ends 14 and 16, and a longitudinal axis 18. Housing 1 2 includes a tubular, cylindrical intermediate body member 20 having first and second axial ends 22 and 24, respectively. Housing 12 further includes first and second end bell members 26 and 28, respectively, each having first and second axial ends. The first end 14 of housing 12 is the same as the first axial end of end bell 26, and end bell 26 includes a second axial end 30. The second end 16 of housing 12 is the same as the second axial end of end bell 28, and end bell 28 includes a first axial end 32.

The intermediate body member 20 and first and second end bell members 26 and 28 are coupled via gasket members 34 and 36, screws 38 associated with the first end bell 26, and screws 39 associated with the second end bell 28. Gasket member 34 is disposed between the second axial end 30 of the first end bell member 26 and the first axial end 22 of the intermediate body member 20. Gasket member 36 is disposed between the second axial end 24 of the intermediate body member and the first axial end 32 of end bell member 28.

Figure 3:
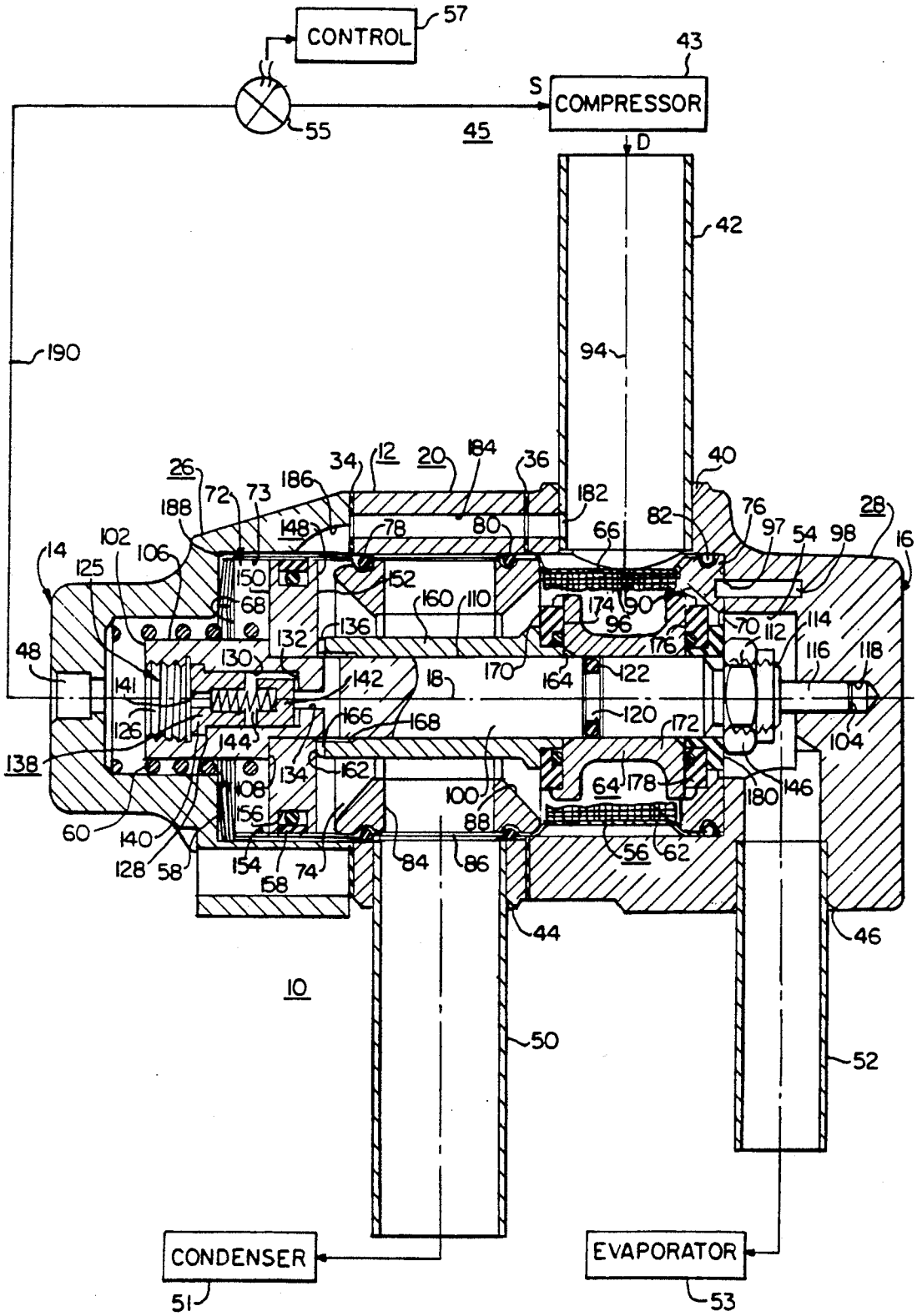
FIG. 3 is a cross-sectional view of the three-way valve shown in FIGS. 1 and 2, taken between and in the direction of arrows III—III in FIG. 1, illustrating the three-way valve in a "cooling" position which directs refrigerant from a refrigerant compressor to a refrigerant condenser.

Housing 12 has an inlet opening 40, best shown in FIG. 3, disposed in the second end bell member 28, such as through a side wall thereof adjacent to the first axial end 32. Opening 40 includes a tubular member 42 soldered in the opening. Tubular member 42 is adapted for connection to the discharge or high pressure side D of a refrigerant compressor 43 of an associated transport refrigeration system 45 shown in FIGS. 3 and 4.

Figure 4:
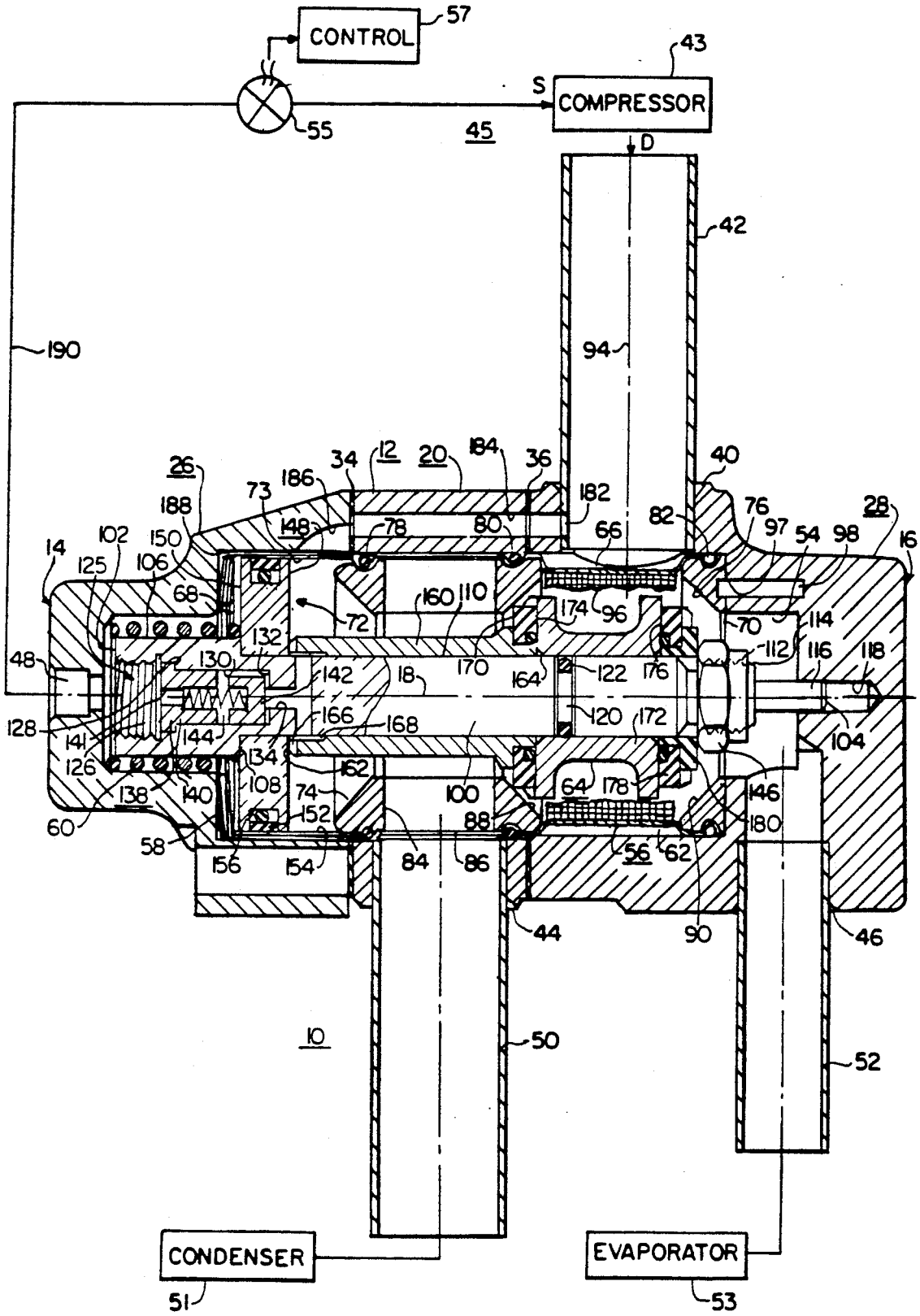
FIG. 4 is a cross-sectional view of the three-way valve shown in FIGS. 1 and 2, which is similar to the cross-sectional view shown in FIG. 3, except illustrating the three-way valve in a "heating" position in which the refrigerant from the compressor is directed to a refrigerant evaporator.

Housing 12 further includes first and second major outlet openings 44 and 46 and a minor outlet opening 48, all shown in FIGS. 3 and 4. The first major outlet opening 44 is provided through the side wall of the intermediate body member 20. A tubular member 50 is soldered into opening 44. Tubular member 50 is adapted for connection to a condenser 51 of the associated refrigeration system 45.

The second major opening 46 is provided in the second end bell member 28, through a side wall thereof, and closer to the second axial end 16 than inlet opening 40. A tubular member 52 is soldered in opening 52, with tubular member 52 being adapted for connection to an evaporator 53 of the associated refrigeration system 45.

The minor outlet opening 48, as shown in FIGS. 3 and 4, is disposed co-axially through the first axial end 14 of the first end bell member 26. Opening 48 is adapted for controllable connection to the suction or low pressure side S of refrigerant compressor 43, such as via a normally closed electrical solenoid valve 55 which is controlled by refrigerant control 57.

The intermediate body portion 20 and first and second end bell members 26 and 28 cooperatively define an axially extending, elongated cavity 54.

Figure 2:
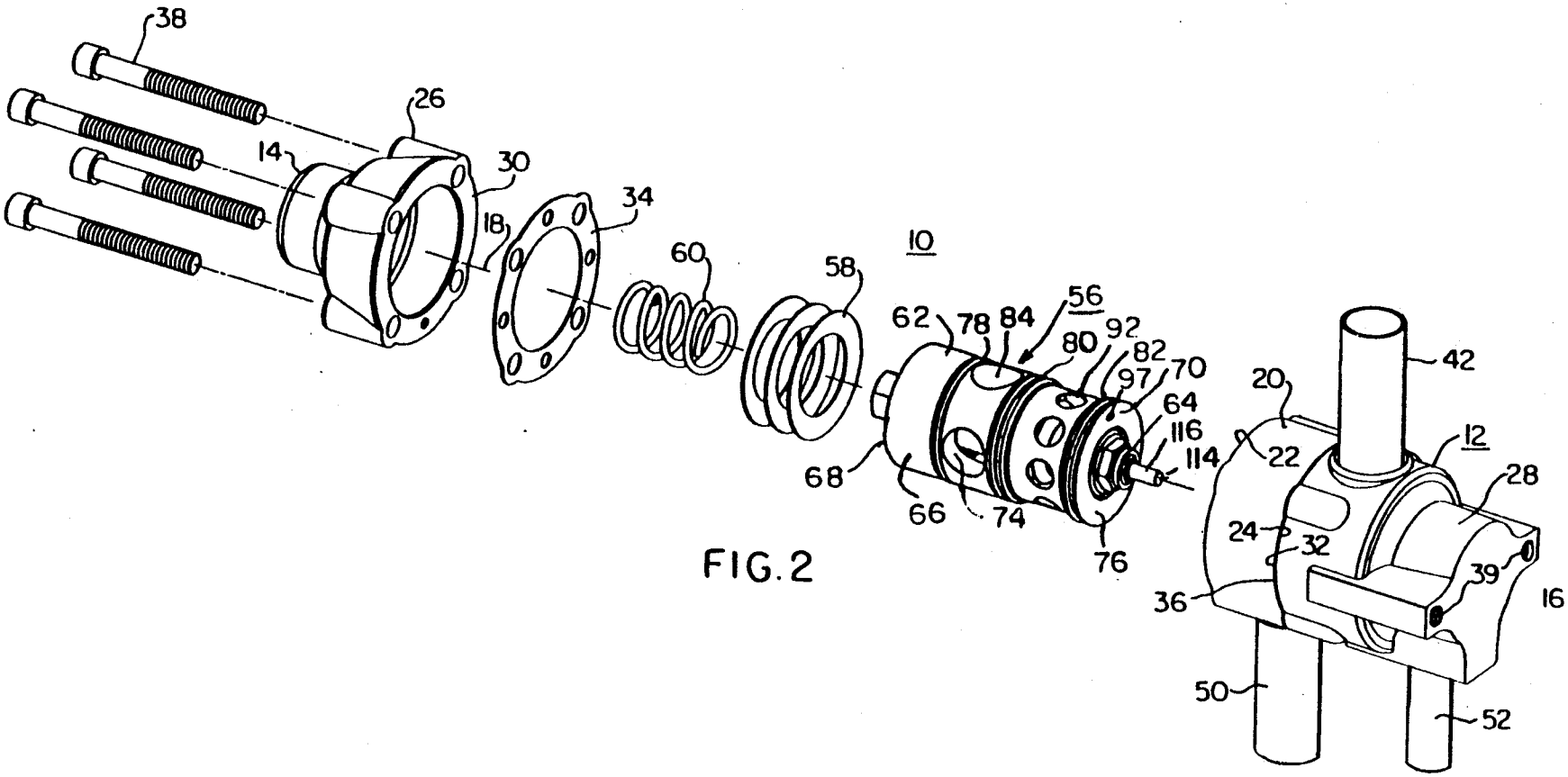
FIG. 2 is a partially exploded perspective view of the three-way valve shown in FIG. 1.

FIG. 2 is a partially exploded perspective view of the three-way valve 10 shown in FIG. 1 illustrating the internal components of three-way valve 10 which are disposed within the cooperatively defined elongated cavity 54. The internal components include a removable cylindrical cartridge 56, first biasing means 58, such as a plurality of Belleville springs, and second biasing means 60, such as a helical compression spring. The first biasing means 58 biases a stationary portion of cartridge 56, and the second biasing means 60 biases a movable portion of cartridge 56, as will be hereinafter explained. The non-exploded portion of housing 12 indicates that this portion of the housing may remain intact while assembling and/or replacing cartridge 56. Thus, only the first end bell member 26 need be removed to service the three-way valve 10.

FIGS. 3 and 4 are cross-sectional views of three-way valve 10 taken between and in the direction of arrows III—III in FIG. 1. FIGS. 3 and 4 illustrate the "cooling" and "heating" positions of three-way valve 10. Cartridge 56 includes stationary and movable portions 62 and 64, respectively. The stationary portion 62 includes a thin-walled tubular metallic shell member 66 having first and second axial ends 68 and 70, and an opening 72 which extends between its ends defined by an inner surface 73. Opening 72 and inner surface 73 thus create an axial bore within which the movable portion 64 of the cartridge 56 is disposed.

The stationary portion 62 includes first and second annular members 74 and 76, respectively. The first annular member 74 is fixed intermediate the axial ends 68 and 70 of shell member 66, such as by roll-formed grooves and bands 78 and 80. The second annular member 76 is fixed adjacent to the second axial end 70, such as by a roll-formed groove and band 82. The first annular member 74 has a plurality of circumferentially spaced openings 84 aligned with similarly dimensioned and spaced openings 86 in shell 66. The first annular member 74 also has a tapered or funnel-shaped surface 88 which functions as a valve seat. The second annular member 76 has a similarly tapered or funnel-shaped surface 90 which also functions as a valve seat.

Shell 66 also has a plurality of circumferentially spaced openings 92, best shown in FIG. 2, the centers of which lie in a plane disposed through the longitudinal axis 94 of the tubular intake member 42, transverse to the longitudinal axis 18 of housing 12. A screen 96, parts of which are shown in FIGS. 3 and 4, is wrapped about shell 66 to cover openings 92, to trap any debris in the refrigerant being discharged by the refrigerant compressor 43 into three-way valve 10 via the tubular intake member 42.

The second annular member 76 includes an opening 97 facing the second end 70 of the stationary portion 62 of cartridge 56 for receiving an indexing pin 98 which is fixed to the second end bell member 28. The indexing pin 98 and complementary opening 97 insure that the openings 84 and 92 in stationary member 62 will be properly circumferentially oriented relative to the tubular members 42 and 50.

The movable portion 64 of cartridge 56 includes an elongated shaft 100 having first and second axial ends 102 and 104, respectively. Shaft 100 has a first diameter starting at the first end 102, defined by outer surface 106. The first diameter extends towards the second end 104 for a predetermined dimension, and it ends at an inwardly stepping shoulder 108. Shoulder 108 steps inwardly to a second diameter defined by a surface 110. Surface 110 extends towards the second end 104 for a predetermined dimension, ending at a threaded portion 112. Threaded portion 112 terminates a predetermined dimension from the second end 104, stepping inwardly at a shoulder 114 to a still smaller diameter defined by a surface 116. Surface 116 extends to the second end 104. The second end bell member 28 has an opening 118 sized to slidably receive the second end 104 of shaft 100, providing a first support point for the movable portion 64 of cartridge 56, while also enabling slidable axial movement of the movable portion 64.

Shaft 100 has a circumferential groove 120 in surface 110 which contains an 0-ring seal 122. Shaft 100 has a transverse opening 124 through the second diameter portion defined by surface closer to shoulder 108 than groove 120.

Shaft 100 has a stepped opening 125 co-axial with axis 18, which opening starts at the first axial end 102 of shaft 100 with a relatively large first diameter defined by an inner surface 126 which is tapped for a predetermined length. Opening 125 steps inwardly at a shoulder 128 to a smaller diameter defined by a smooth surface 130. Surface 130 ends at a wall portion 132 which has a small central opening 134 which continues the stepped opening 125 into fluid flow communication with the transverse opening 124. Wall portion 132 includes a raised lip 136 which surrounds the entrance to opening 134.

A pressure equalizing or limiting check valve 138 is removably fixed in the stepped opening 125. Check valve 138 includes a fixed portion 140, which includes an axially extending through opening 141, and a movable portion 142 which is biased against lip 136 via a helical compression spring 144.

Shaft 100 includes a plurality of members which are telescoped over the second end 104 and firmly held in serial alignment by a nut 146 which engages the tapped portion 112. The first of such members is a piston 148 which is disposed against shoulder 108. Piston 148 has first and second opposed pressure receptive surfaces 150 and 152 disposed transverse to axis 18. Piston 148 has an outer periphery 154 having a circumferential groove 156 having sealing means 158 disposed therein, such as the illustrated cup seal with expander. Sealing means 158 slidingly engages the inner surface 73 of shell 66, providing a second slidable support point for the movable portion 64 of cartridge 56.

The next member telescoped onto shaft 100 is a elongated sleeve member 160 having first and second axial ends 162 and 164, respectively. End 162 has a transverse slot 166 which communicates with a machined relief 168 on the inside diameter of sleeve member 160 which surrounds the transverse opening 124 in shaft 100. Slot 166, relief 168, and openings 124 and 134 enable the movable portion 142 of check valve 138 to be responsive to back pressure produced by the refrigerant condenser 51 via tubular member 50 when three-way valve 10 is in the "heating" position shown in FIG. 4, as will be hereinafter explained.

The second end 164 of sleeve 160 is stepped to receive a first elastomeric valve seal 170, which cooperates with the stationary valve seat surface 88 of the first annular member 74, as shown in FIG. 4, when three-way valve 10 is in the "heating" position.

A spacer member 172 has a first axial end 174 which holds the first valve seal 170 in the desired position, and a second axial end 176. A second elastomeric valve seal 178 is disposed against the second axial end 176 of spacer member 172 and held in position by an elastomeric washer 180 and the nut 146. The second valve seal 178 co-operates with the stationary valve seat surface 90 of the second annular member 76 when three-way valve 10 is in the "cooling" position shown in FIG. 3.

Reviewing the structure of three-way valve 10 described to this point, it will be noted that the housing 12 has no valve parts subject to wear, and that the cavity 54 defined by housing 12 is cylindrical with no parts which interfere with the axial placement or removal of the cartridge 56.

In the assembly of three-way valve 10, the intermediate body member 20 and the second end bell member 28 are joined at a joint sealed via gasket member 36, and held in assembled relation with screws 39. The cartridge 56 is then inserted into cavity 54 such that the second axial end 104 of shaft 100 enters opening 118 in the second end bell member 28. The stationary portion 62 of cartridge 54 is then rotated until indexing pin 98 enters opening 97 in the second annular member 76. Belleville springs 58 and helical spring 60 are positioned inside the first end bell member 26, gasket 34 is positioned between the first end bell member 26 and the intermediate body member 20, and screws 38 are positioned and actuated to firmly secure the first end bell member 26 to the intermediate body member 20. The Belleville springs 58 bias the stationary portion 62 of cartridge 56 against the second end bell member 28, and the helical spring 60 contacts surface 150 of piston 148 to provide a force which biases the movable portion 64 towards the second end bell member 28.

The relatively high discharge pressure of the refrigerant compressor is communicated to the first pressure receptive side 150 of piston 148 via an opening 182 in the side wall of tubular member 42, a longitudinally extending opening 184 through the outer wall of intermediate body member 20, and an opening or groove 186 in the first end bell member 26. The outside diameter of shell 66 and the surrounding inside diameter of the first end bell member 26 are selected to provide a small spacing 188 between them, sufficient to continue the pressure path from the aligned openings 182, 184 and 186 to the first pressure receptive surface 150 of piston 148.

When refrigerant conduit 190 joining opening 48 to the suction side S of the refrigerant compressor 43 is closed by the de-energized position of solenoid valve 55, as shown in FIG. 3, the bias of spring 60 plus the compressor discharge pressure on surface 150 of piston 148 provides a force which exceeds the force created by the compressor discharge pressure on surface 152 of piston 148. This results in a differential force which moves the movable portion 64 of cartridge 56 to the cooling position of three-way valve 10 shown in FIG. 3. In the cooling position of three-way valve 10 the second elastomeric valve seal 178 is firmly seated against the tapered surface 90 to close the refrigerant path to the tubular member 52, and thus to the evaporator 53, while opening the refrigerant path to the tubular member 50 and condenser 51. Thus, refrigerant entering three-way valve 10 via tubular member 42 enters cartridge 56 via opening 92 and it flows out of three-way valve 10 to the refrigerant condenser 51 via tubular member 50.

When refrigerant control 57 senses that a heating cycle should be initiated in order to hold a selected set point temperature in a served spaced, and also when control 57 determines that the evaporator 53 requires defrosting, control 57 energizes solenoid valve 55 to actuate it to its open position and vent the refrigerant providing the pressure on side 150 of piston 148 to the low side S of compressor 43. The force provided by compressor discharge pressure on side 152 now exceeds the force provided by the bias of spring 60 and the low suction pressure, providing a resulting force which moves the movable portion 64 of cartridge 56 to the heating position shown in FIG. 4. In the heating position, elastomeric valve seal 170 firmly seats against tapered valve seat surface 88. This position of three-way valve 10 closes the refrigerant path to the condenser 51 and opens it to the evaporator 53.

With certain refrigerants during certain operating conditions the pressure in condenser 51 may rise during a heating cycle and add additional pressure to the second side 152 of piston 148. Then, when control 57 closes solenoid valve 55 to switch three-way valve 10 back to the cooling position shown in FIG. 3, the force acting upon surface 150 provided by the combination of the bias provided by spring 60 and the condenser discharge pressure may not exceed the force provided by the combination of the compressor discharge pressure plus the back pressure from the condenser 51. Thus, three-way valve 10 will not shift back to the cooling position shown in FIG. 3. The pressure limiting check valve 138 prevents this condition from occurring. The back pressure from condenser 51 is applied to the movable portion 142 of check valve 138, and if it exceeds the bias of spring 144 the movable portion 142 is lifted from the seating lip 136, venting the back pressure to the low side S of compressor 43 via the control opening 141 in fixed portion 140 of check valve 138.

When three-way valve 10 requires servicing in the field, it is only necessary to remove screws 38, the first end bell member 26, springs 58 and 60 and gasket 34. No solder joints are broken. A cartridge removal tool is then threadably engaged with tapped opening 126 in the first axial end 102 of shaft 100, and the cartridge 56 is withdrawn from cavity 54. A new or rebuilt cartridge is then inserted into cavity 54, as hereinbefore described relative to the assembly of three-way valve 10. All of the valve parts subject to wear are thus removed when the used cartridge 56 is removed, and the three-way valve 10 is easily reassembled using a new gasket 34 and a new or rebuilt cartridge 56.

We claim:

1. A three-way valve for a refrigeration system having a condenser, an evaporator, and a refrigerant compressor which includes discharge and suction sides, with the three-way valve comprising a body portion including an intermediate body member having first and second axial ends, and first and second end bell members removably fixed to the first and second axial ends, respectively, via first and second gasket members, with the intermediate body member and first and second end bell members cooperatively defining an axially extending elongated cavity, the body portion further including an inlet adapted for connection to the discharge side of the refrigerant compressor, first and second major outlets adapted for connection to the condenser and evaporator, respectively, which are alternately selectable by the three-way valve, and a minor outlet adapted for selective connection to the suction side of the refrigerant compressor, characterized by:

a cylindrical cartridge removably disposed within said elongated cavity, said cartridge carrying co-operably stationary and movable portions of the three-way valve, including first and second spaced stationary valve seats and first and second spaced valve seals which respectively contact the first and second valve seats to provide first and second operative positions which respectively connect the inlet of the body portion to the first and second major outlets, first bias means disposed between the first end bell member and the stationary portion of the cartridge which biases the stationary portion of the cartridge against a portion of the second end bell, and second bias means disposed between the first end bell member and the movable portion of the cartridge which biases the movable portion towards the second end bell member, said stationary portion of the cartridge including a hollow cylindrical shell having an inner surface which defines an axially extending bore, with the first and second valve seats being fixed to said inner surface, said movable portion of the cartridge including a piston having first and second spaced, opposed, pressure receptive surfaces oriented perpendicular to the longitudinal axis of said elongated cavity, with said piston being mounted for axially slidable movement relative to the inner surface of the shell, with said movable portion carrying the first and second valve seals which respectively contact the first and second valve seats, wherein the cartridge is removable from the body portion for maintenance purposes, without interference between the cartridge and body portion, by removal of a predetermined one of the end bell members.

2. The three-way valve of claim 1 wherein the cylindrical cartridge has first and second axial ends respectively disposed within the first and second end bell members.

3. The three-way valve of claim 1 wherein the predetermined one of the end bells is the first end bell member, with the second end bell member having an opening which receives and slidably guides one end of the movable portion of the cartridge.

4. The three-way valve of claim 3 wherein the second end bell and the second axial end of the cartridge have complementary engaging portions which circumferentially index the stationary portion of the cartridge.

5. The three-way valve of claim 1 wherein the minor outlet is disposed in the first end bell, the first major outlet is disposed in the intermediate member, and the inlet and second major outlet are disposed in the second end bell.

6. A three-way valve for a refrigeration system having a condenser, an evaporator, and a refrigerant compressor which includes discharge and suction sides, with the three-way valve comprising a body portion including an intermediate body member having first and second axial ends, and first and second end bell members removably fixed to the first and second axial ends, respectively, via first and second gasket members, with the intermediate body member and first and second bell members cooperatively defining an axially extending elongated cavity, the body portion further including an inlet adapted for connection to the discharge side of the refrigerant compressor, first and second major outlets adapted for connection to the condenser and evaporator, respectively, which are alternately selectable by the three-way valve, and a minor outlet adapted for selective connection to the suction side of the refrigerant compressor, characterized by:

a cylindrical cartridge removably disposed within said elongated cavity, said cartridge carrying co-operably stationary and movable portions of the three-way valve, including first and second spaced stationary valve seats and first and second spaced valve seals which respectively contact the first and second valve seats to provide first and second operative positions which respectively connect the inlet of the body portion to the first and second major outlets, and an equalizing check valve carried by the cartridge, said equalizing check valve being disposed to limit back pressure build up in the cartridge via the first major outlet when the inlet of the body portion is operatively connected to the second major outlet, wherein the cartridge is removable from the body portion for maintenance purposes, without interference between the cartridge and body portion, by removal of a predetermined one of the end bell members.

7. A three-way valve for a refrigeration system having a condenser, an evaporator, and a refrigerant compressor which includes discharge and suction sides, with the three-way valve comprising a body portion including an intermediate body member having first and second axial ends, and first and second end bell members removably fixed to the first and second axial ends, respectively, via first and second gasket members, with the intermediate body member and first and second end bell members cooperatively defining an axially extending elongated cavity, the body portion further including an inlet adapted for connection to the discharge side of the refrigerant compressor, first and second major outlet adapted for connection to the condenser and evaporator, respectively, which are alternately selectable by the three-way valve, and a minor outlet adapted for selective connection to the suction side of the refrigerant compressor, characterized by:

a cylindrical cartridge removably disposed within said elongated cavity, said cartridge carrying co-operable stationary and movable portions of the three-way valve, including first and second spaced stationary valve seats and first and second spaced valve seals which respectively contact the first and second valve seats to provide first and second operative positions which respectively connect the inlet of the body portion to the first and second major outlets, and an equalizing check valve co-axially disposed within the cartridge, with the check valve linking the first major outlet with the minor outlet with an orientation which limits back pressure build up in the cartridge via the first major outlet when the inlet of the body portion is operatively connected to the second major outlet, wherein the cartridge is removable from the body portion for maintenance purposes, without interference between the cartridge and body portion, by removal of a predetermined one of the end ball members.

8. A three-way valve for a refrigeration system having a condenser, an evaporator, and a refrigerant compressor which includes discharge and suction sides, with the three-way valve comprising a body portion including an intermediate body member having first and second axial ends, and first and second end bell members removably fixed to the first and second axial ends, respectively, via first and second gasket members, with the intermediate body member and first and second end bell members cooperatively defining an axially extending elongated cavity, the body portion further including an inlet adapted for connection to the discharge side of the refrigerant compressor, first and second major outlet adapted for connection to the condenser and evaporator, respectively, which are alternately selectable by the three-way valve, and a minor outlet adapted for selective connection to the suction side of the refrigerant compressor, characterized by:

the minor outlet being disposed in the first end bell, the first major outlet being disposed in the intermediate member, and the inlet and second major outlet being disposed in the second end bell, a cylindrical cartridge removably disposed within said elongated cavity, said cartridge carrying co-operable stationary and movable portions of the three-way valve, including first and second spaced stationary valve seats and first and second spaced valve seals which respectively contact the first and second valve seats to provide first and second operative positions which respectively connect the inlet of the body portion to the first and second major outlets, said stationary portion of the cartridge including a hollow cylindrical shell having an inner surface which defines an axially extending bore, with the first and second valve seats being fixed to said inner surface, said movable portion of the cartridge including a shaft having first and second ends, with the second end being slidably supported by the second end bell, a piston on the shaft spaced inwardly from the first end of the shaft, with said piston having first and second opposed pressure receptive surfaces which respectively face the first and second ends of the shaft, and an outer surface slidably engaged with the inner surface of the cylindrical shell of the stationary portion of the cartridge, said first and second pressure receptive surfaces being oriented perpendicular to the longitudinal axis of said elongated cavity, with said piston being mounted for axially slidable movement relative to the inner surface of the shell, and with said movable portion carrying the first and second valve seals which respectively contact the first and second valve seats, wherein the cartridge is removable from the body portion for maintenance purposes, without interference between the cartridge and body portion, by removal of a predetermined one of the end bell members.

9. The three-way valve of claim 8 including an opening in the first end of the shaft defining a cavity co-axial with the shaft which is fluid flow communication with a lateral opening in the shaft which is disposed between the second pressure receptive surface of the piston and the second end of the shaft, and including a pressure limiting check valve disposed in the cavity defined by the shaft, oriented to limit pressure build up on the second surface of the piston when the minor outlet is operatively connected to the suction side of the refrigerant compressor.

* * * * *